US008720750B2

(12) United States Patent
De Clerck

(10) Patent No.: US 8,720,750 B2
(45) Date of Patent: May 13, 2014

(54) NON-SLIP METAL WIRE CLOTHES HANGER

(75) Inventor: Marc De Clerck, Crestwood, KY (US)

(73) Assignee: NV Bekaert SA, Zwevegem (BE)

( * ) Notice: Subject to any disclaimer, the term of this patent is extended or adjusted under 35 U.S.C. 154(b) by 19 days.

(21) Appl. No.: 13/511,299

(22) PCT Filed: Nov. 23, 2010

(86) PCT No.: PCT/EP2010/068024

§ 371 (c)(1),
(2), (4) Date: May 22, 2012

(87) PCT Pub. No.: WO2011/064204

PCT Pub. Date: Jun. 3, 2011

(65) Prior Publication Data

US 2012/0248158 A1 Oct. 4, 2012

Related U.S. Application Data

(63) Continuation of application No. 12/591,601, filed on Nov. 24, 2009.

(51) Int. Cl.
*A41D 27/22* (2006.01)
*A41D 27/00* (2006.01)

(52) U.S. Cl.
USPC ..... 223/98

(58) Field of Classification Search
USPC ..... 223/85–98; 248/302–308
See application file for complete search history.

(56) References Cited

U.S. PATENT DOCUMENTS

| | | | | |
|---|---|---|---|---|
| 2,047,129 | A | 7/1936 | Randall | |
| 2,101,195 | A | 12/1937 | Randall | |
| 2,205,524 | A | 6/1940 | Gareis | |
| 3,083,425 | A | 4/1963 | Minnerly, Jr. | |
| 3,604,067 | A | 9/1971 | Brown | |
| 3,807,609 | A * | 4/1974 | Tymoszek | 223/88 |
| 3,913,181 | A | 10/1975 | Walker | |
| 4,017,337 | A | 4/1977 | Winter et al. | |
| 4,055,874 | A | 11/1977 | Brown | |
| 4,148,114 | A | 4/1979 | Wier | |
| 4,246,317 | A | 1/1981 | Helwig | |
| 4,517,066 | A | 5/1985 | Benko | |
| 4,521,455 | A | 6/1985 | Domokos | |
| 4,542,876 | A | 9/1985 | Hogg | |

(Continued)

FOREIGN PATENT DOCUMENTS

| | | |
|---|---|---|
| DE | 86 15 584 U1 | 7/1986 |
| DE | 92 06 199 U1 | 9/1993 |

(Continued)

OTHER PUBLICATIONS

International Search Report (ISR) in International Application No. PCT/EP2010/068024, dated Feb. 1, 2011 (3 pgs.).

(Continued)

*Primary Examiner* — Ismael Izabuirre
(74) *Attorney, Agent, or Firm* — Shlesinger, Arkwright & Garvey LLP

(57) ABSTRACT

Metal wire coated with a thermoplastic elastomer has non-slip properties, especially suited for textile and paper. The coated metal wire is further mechanically deformable for use as a clothes hanger or a paperclip.

17 Claims, 3 Drawing Sheets

(56) References Cited

U.S. PATENT DOCUMENTS

| | | | | |
|---|---|---|---|---|
| 4,982,590 | A | 1/1991 | Yoshida | |
| 5,329,672 | A | 7/1994 | Froehlich et al. | |
| 5,852,118 | A * | 12/1998 | Horrion et al. | 525/90 |
| 6,012,620 | A * | 1/2000 | Murray | 223/98 |
| 6,338,426 | B1 * | 1/2002 | Okiyama | 223/96 |
| 7,216,786 | B2 * | 5/2007 | Mikhail et al. | 223/85 |
| 7,829,623 | B2 * | 11/2010 | Ouhadi et al. | 524/502 |
| 2007/0090251 | A1 * | 4/2007 | Padden | 248/303 |
| 2011/0123811 | A1 | 5/2011 | Clerck | |
| 2013/0214015 | A1 * | 8/2013 | Wood et al. | 223/85 |

FOREIGN PATENT DOCUMENTS

| | | | |
|---|---|---|---|
| DE | 44 21 027 | A1 | 12/1995 |
| DE | 20 2009 002088 | U1 | 8/2010 |
| FR | 1 393 435 | A | 3/1965 |
| WO | WO 9955793 | A1 | 11/1999 |

OTHER PUBLICATIONS

Pouzada, et al., "Friction properties of moulding thermoplastics"; (2006), Polymer Testing 25; pp. 1017-1023.

Factors Affecting the friction between surfaces; http://www.gotstogo.com/misc/engineering info/Coefficients%20of%20Friction.htm, undated, 12 pgs., cited in U.S. Appl. No. 12/591,601.

Argonics Engineered Polyurethance, Coefficient of Friction Test, www.argonics.com, undated, 8 pgs., cited in U.S. Appl. No. 12/591,601.

PCT Written Opinion of the International Searching Authority of PCT/EP2010/068024, dated May 30, 2012 (5 pgs).

* cited by examiner

NON-SLIP METAL WIRE CLOTHES HANGER

CROSS-REFERENCE TO RELATED APPLICATIONS

This application is a national stage application of international application no. PCT/EP2010/068024, filed Nov. 23, 2010, and this application no. PCT/EP2010/068024 is a continuation of U.S. application Ser. No. 12/591,601, filed Nov. 24, 2009.

FIELD OF THE INVENTION

The invention relates to a non-slip metal wire for use as a clothes hanger, paper clip, and the like.

BACKGROUND OF THE INVENTION

There are three basic types of clothes hangers. The first is the wire hanger, which has a simple loop of wire, most often steel, in a flattened triangle shape that continues into a hook at the top. The second is the wooden hanger, which consists of a flat piece of wood cut into a boomerang-like shape with the edges sanded down to prevent damage to the clothing, and a hook, usually of metal, protruding from the point. Some wooden hangers have a rounded bar from tip to tip, forming a flattened triangle. This bar is designed to hang the trousers belonging to the jacket. The third kind and most used in today's world are also plastic coat hangers, which mostly mimic the shape of either a wire or wooden hanger. Plastic coat hangers are also produced in smaller sizes to accommodate the shapes of children's clothes.

Some hangers have clips along the bottom for suspending skirts. Dedicated skirt and trousers hangers may not use the triangular shape at all, instead using just a rod with clips. Specialized pant hanger racks may accommodate many pairs of trousers. Foldable clothes hangers that are designed to be inserted through the collar area for ease of use and the reduction of stretching are an old, yet potentially useful variation on traditional clothes hangers.

Wire is versatile, and wire clothes hangers are cheap. Wire may also be used in combination with wooden or plastic hangers, e.g. as wired trouser bar, or (partly) inserted into the wood or plastic. Other hanger systems optionally using wire are clothes valets, laundry racks and laundry drying racks or wires.

Some metal wired clothes hangers are applied locally with an anti-slip slid over the surface of the metal where the clothes contact the hanger. This may be on the shoulder part for hanging shirts, or the bar part for hanging trousers, or even inside the clips along the bottom of a hanger for suspending skirts.

However, such anti-slip slids are post-fabricated and mounted in a subsequent operation step onto the hangers or hanger systems. This involves a costly subsequent operation in the production process. Moreover said anti-slip slids often do not provide sufficient friction for holding clothes.

On the other hand, applying anti-slip slids in one operation onto a metal wire gives problems of adhesion of the anti-slip slids to said metal surface. Also, when a metal wire is coated with an anti-slip layer, the wire still needs to be mechanically deformed to form a clothes hanger or a paperclip. Problems may arise with fraying said layer or with damaging said layer.

Yet another problem is that the anti-slip coating must be resistant to solvents, like e.g. in the case of solvents used in dry-cleaning.

Yet a major problem is cost-effectiveness. Metal clothes hangers are a very cheap commodity product. Adding an anti-slip coating will have to be very cost-effective.

OBJECTS AND SUMMARY OF THE INVENTION

It is a general object of the present invention to provide a non-slip mechanically deformable elongated metal element for use in e.g. clothes hangers and paperclips.

It is an object of the present invention to provide an elongated metal element with a well-adhered non-slip layer that is produced in one operation step, that has sufficient friction for holding clothes or paper, and that is mechanically deformable without damaging the non-slip layer on the metal element.

It is also an object of the present invention to provide a coated elongated metal element resistant against solvents, like those used in dry-cleaning.

It is a further object of the present invention to provide a cost-effective anti-slip metal clothes hanger.

It is still another object of the present invention to provide a coated elongated metal element that gives a soft touch.

According to a first aspect of the present invention there is provided an elongated metal element coated with a thermoplastic, such as a thermoplastic elastomer or thermoplastic polyurethane, wherein said thermoplastic has static friction coefficient of at least 0.180, e.g. at least 0.190, e.g. at least 0.200.

The dynamic friction coefficient of the coated elongated metal element is at least 0.165, e.g. at least 0.170, e.g. at least 0.180.

The relative high coefficients of friction make the elongated metal element suitable for use as or in a clothes hanger or for use as a paper clip.

One aspect of the invention relates to a cloth hanger, comprising a hook portion; at least one shoulder portion having a top end and a bottom end; and at least one base portion extending from the bottom end of said shoulder portion; wherein said shoulder portion, said base portion and optionally the hook portion is formed from a single elongated metal core provided with a thermoplastic coating selected from a group consisting of a thermoplastic elastomer and a thermoplastic polyurethane.

When hanging clothes e.g. it is desired that the hanger has a smooth feel though a friction coefficient which is sufficient to hold the clothes firmly in place on the hanger. The friction coefficient ($\mu$) describes the ratio of the force of friction between two bodies and the force pressing them together, such as the friction between a coated metal wire and clothing, or the friction between coated metal wire and paper.

Static friction is friction between two solid objects that are not moving relative to each other. For example, static friction can prevent an object from sliding down a sloped surface. The static friction force $F_s$ is the force needed to move a particular object where a normal force $F_n$ is working on. The static friction coefficient $\mu_s$ is the ratio $F_s/F_n$.

Kinetic or dynamic friction occurs when two objects are moving relative to each other and rub together. The dynamic friction force $F_d$ is the force needed to keep an object where a normal force $F_n$ is working on, in movement. The coefficient of kinetic friction $\mu_d$ is equal to the ratio $F_d/F_n$ and is usually less than the coefficient of static friction $\mu_s$ for the same materials.

In a preferred embodiment said coated metal wire is plastically deformed. The thermoplastic elastomers on the elongated metal element can be subject to deformation without being damaged.

Next to thermoplastic elastomers and thermoplastic polyurethanes, thermoplastics in general may be used on condition that they have friction coefficients which are high enough. Such a high friction coefficient may be obtained, e.g. by roughening the coating surface with a post-treatment, e.g. by blasting the coating surface with particles.

In yet another preferred embodiment the thermoplastic elastomer is a thermoplastic vulcanizate. An example of such a vulcanizate is currently marketed under the trademark Santoprene®. An elongated metal element coated with Santoprene® has a very favourable friction coefficient and may resist to mechanical deformations without fraying or damage.

The thermoplastic polymer coating layer forms a coating on the metal substrate with a coating thickness ranging from 5 μm to 500 μm, preferably from 10 μm to 250 μm, more preferably 15 μm to 100 μm. In most cases coating thicknesses less than 50 μm are suitable.

The term "thermoplastic elastomer (TPE)" in general defines blends of polyolefins and rubbers in which blends the rubber phase is not cured, i.e., so called thermoplastic olefins (TPO), blends of polyolefins and rubbers in which blends the rubber phase has been partially or fully cured by a vulcanization process to form thermoplastic vulcanizates (TPV), or unvulcanized block-copolymers or blends thereof.

The thermoplastic elastomer may be selected from (A) (a) a thermoplastic polyolefin homopolymer or copolymer, and
  (b) an olefinic rubber which is fully crosslinked, partially crosslinked or not crosslinked, and optionally
  (c) common additives; or
(B) (a) a block-copolymer of styrene/conjugated diene/styrene and/or its fully or partially hydrogenated derivative, optionally compounded with
  (b) a thermoplastic polyolefin homopolymer or copolymer and/or
  (c) common additives; or
(C) any blend of (A) and (B).

Polyolefins suitable for use in the compositions (A), (B) or (C) include thermoplastic, crystalline polyolefin homopolymers and copolymers. They are desirably prepared from monoolefin monomers having 2 to 7 carbon atoms, such as ethylene, propylene, 1-butene, isobutylene, 1-pentene, 1-hexene, 1-octene, 3-methyl-1-pentene, 4-methyl-1-pentene, 5-methyl-1-hexene, mixtures thereof and copolymers thereof with (meth)acrylates and/or vinyl acetates. Preferred, however, are monomers having about 3 to about 6 carbon atoms, with propylene being preferred. The term "polypropylene" includes homopolymers of propylene as well as reactor and/or random copolymers of polypropylene which can contain about 1 to about 30 wt % of ethylene and/or an α-olefin comonomer of about 4 to about 16 carbon atoms, and mixtures thereof. The polypropylene can be highly crystalline isotactic or syndiotactic polypropylene.

Commercially available polyolefins may be used. Further polyolefins which can be used are high, low, linear-low, very low-density polyethylenes and copolymers of ethylene with (meth)acrylates and/or vinyl acetates.

The polyolefins mentioned above can be made by conventional Ziegler/Natta catalyst systems or by single-site catalyst-systems.

The amount of polyolefin found to provide useful compositions (A) is generally from about 8 to about 90 weight percent, under the proviso that the total amount of polyolefin (a) and rubber (b) is at least about 35 weight percent, based on the total weight of the polyolefin (a), rubber (b) and optional additives (c). Preferably, the polyolefin content will range from about 10 to about 60 percent by weight.

Suitable monoolefin copolymer rubbers comprise non-polar, rubbery copolymers of two or more a-monoolefins, preferably copolymerized with at least one polyene, usually a diene.

Saturated monoolefin copolymer rubber, for example ethylene-propylene copolymer rubber (EPM) can be used. However, unsaturated monoolefin rubber such as EPDM rubber is more suitable. EPDM is a terpolymer of ethylene, propylene and a non-conjugated diene.

Satisfactory non-conjugated dienes include 5-ethylidene-2-norbornene (ENB); 1,4hexadiene; 5-methylene-2-norbornene (MNB); 1,6-octadiene; 5-methyl-1,4-hexadiene; 3,7-dimethyl-1,6-octadiene; dicyclopentadiene (DCPD) and vinyl norbornene (VNB).

Butyl rubbers are also useful in the compositions of the invention. The term "butyl rubber" includes copolymers of an isoolefin and a conjugated monoolefin, terpolymers of an isoolefin with or without a conjugated monoolefin, divinyl aromatic monomers and the halogenated derivatives of such copolymers and terpolymers.

The useful butyl rubber copolymers comprise a major portion of isoolefin and a minor amount, usually less than about 30 wt %, of a conjugated multiolefin. The preferred copolymers comprise about 85-99.5 wt % of a C4 7 isoolefin such as isobutylene and about 15-0.5 wt % of a multiolefin of 4-14 carbon atoms, such as isoprene, butadiene, dimethyl butadiene and piperylene. Commercial butyl rubber, chlorobutyl rubber, bromobutyl rubber, useful in the invention, are copolymers of isobutylene and minor amounts of isoprene with less than about 3% halogen for the halobutyl-derivatives. Other butyl co- and terpolymer rubbers are illustrated by the description in U.S. Pat. No. 4,916,180, the disclosure of which is incorporated herein by reference.

Another suitable copolymer within the scope of the olefinic rubber of the present invention is a copolymer of a C4 7 isomonoolefin and a para-alkylstyrene, and to preferably a halogenated derivative thereof. The amount of halogen in the copolymer, predominantly in the paraalkylstyrene, is from about 0.1 to 10 wt %. A preferred example is the brominated copolymer of isobutylene and para-methylstyrene. These copolymers are more fully described in U.S. Pat. No. 5,162,445, the disclosure of which is incorporated herein by reference.

A further olefinic rubber suitable in the invention is natural rubber. The main constituent of natural rubber is the linear polymer cis-1,4-polyisoprene. It is normally commercially available in the form of smoked sheets and crepe. Synthetic polyisoprene can also be used.

Furthermore polybutadiene rubber and styrene-butadiene-copolymer rubbers can also be used.

Blends of any of the above olefinic rubbers can be employed, rather than a single olefinic rubber.

Further suitable rubbers are nitrile rubbers. Examples of the nitrile group-containing rubber include a copolymer rubber comprising an ethylenically unsaturated nitrile compound and a conjugated diene. Further, the copolymer rubber may be one in which the conjugated diene units of the copolymer rubber are hydrogenated.

Specific examples of the ethylenically unsaturated nitrile compound include acrylonitrile, achloroacrylonitrile, a-fluoroacrylonitrile and methacrylonitrile. Among them, acrylonitrile is particularly preferable.

Examples of the conjugated diene include 1,3-butadiene, 2-chlorobutadiene and 2-methyl 1,3-butadiene (isoprene). Among them, butadiene is particularly preferable.

Especially preferred nitrile rubbers comprise copolymers of 1,3-butadiene and about 10 to about 50 percent of acrylonitrile.

Other suitable rubbers in terms of the present invention are based on polychlorinated butadienes such as polychloroprene rubber. These rubbers are commercially available under the trade names Neoprene® (or polychloroprene which is a family of synthetic rubbers that are produced by polymerization of chloroprene) and Bayprene® (or xanthogen-modified polychloroprene rubber with fast crystallization rate).

In preparing the compositions of the invention, the amount of rubber in composition (A) generally ranges from about 70 to about 10 weight percent, under the proviso that the total amount of polyolefin (a) and rubber (b) is at least about 35 weight %, based on the weight of the polyolefin (a), the rubber (b) and the optional additives (c). Preferably, the olefinic rubber content will be in the range of from about 50 to about 10 weight percent.

The thermoplastic elastomer may contain reinforcing and non-reinforcing fillers, plasticizers, antioxidants, stabilizers, rubber processing oil, extender oils, lubricants, antiblocking agents, antistatic agents, waxes, foaming agents, pigments, flame retardants and other processing aids known in the rubber compounding art. Such additives can comprise up to about 40 wt %, preferably up to 20 wt % of the total compatibilized blend.

Fillers and extenders which can be utilized include conventional inorganics such as calcium carbonate, clays, silica, talc, titanium dioxide, carbon black, and the like. The rubber processing oils generally are paraffinic, naphthenic or aromatic oils derived from petroleum fractions. The oils are selected from those ordinarily used in conjunction with the specific rubber or rubbers present in the composition.

Santoprene® is a thermoplastic vulcanizate (TPV) in the thermoplastic elastomer (TPE) family. Santoprene® complies with FDA regulations for rubber articles intended for repeated use. It can be processed on conventional thermoplastics equipment for extrusion. Santoprene® is polyolefin based and completely recyclable.

In one embodiment said thermoplastic elastomer may be applied on the metal wire without any additional coating in between.

In a specific embodiment the metal wire comprises an adhesion layer fully or partially applied between said metal wire and said thermoplastic elastomer, comprising (i) a functionalized polymer containing functional groups selected from carboxylic acids or anhydrides, epoxy groups, amino groups, oxazoline groups and hydroxy groups; and (ii) a compound selected from copolyamides, copolyesters, and polyamides or blends thereof.

WO 99/55793 describes a thermoplastic elastomer (TPE) reinforced with a metal element. The outer layer of the metal element has an adhesive tie-layer for adhering said thermoplastic elastomer to it.

In yet another specific embodiment the metal wire comprises an adhesion layer fully or partially applied between said metal wire and said thermoplastic elastomer, comprising a compound selected from organo functional silanes, organo functional titanates and organo functional zirconates.

In another embodiment the metal wire further comprises a primer coating interposed between said metal wire and said adhesion layer. In a specific embodiment said primer coating comprises a compound selected from organo functional silanes, organo functional titanates and organo functional zirconates.

Prior to applying the coating/adhesive layer the surface of the metal may optionally be treated with a primer (or "coupling agent") selected from organo functional silanes, organo functional titanates and organo functional zirconates which are known in the art for said purpose.

The organo functional silane primers are selected from compounds of the following formula:

$$Y—(CH_2)_n—SiX_3 \text{ wherein}$$

Y represents an organo functional group selected from $—NH_2$, $CH_2═CH—$, $CH_2═C(CH_3)COO—$, 2,3-epoxypropoxy, HS— and, Cl—;

X represents a silicon functional group selected from —OR, —OC(═O)R', —Cl wherein R and R' are independently be selected from $C_1$-$C_4$ alkyl, preferably $—CH_3$ and $—C_2H_5$; and n is an integer from 0 and 20, preferably from 0 to 10 and most preferably from 0 to 3.

The organo functional silanes described above are commercially available products. They are available, for instance, under the tradename Dynasylan®.

The organo functional titanate primers are selected from compounds of the following formula:

$$R''_mMR'''_{(4-m)} \text{ wherein}$$

m is an integer from 1 to 3, preferably 2 or 3;

R" represent a functional group selected from CH, ═CHOO—, CH, $═(CH_3)COO$ and 2,3-epoxypropoxy;

R''' represents a straight or branched alkyl group containing 1 to 6, preferably up to 4 carbon atoms; and M represents Ti or Zr.

A preferred organo functional titanate primer is $[CH_2═C(CH_3)COO]3TiOCH(CH_3)_2$ (methacrylate titanate commercially available as TTN-33 from the Kenrich Company).

In one embodiment the metal core of said elongated metal element is a metal/metal alloy from the group consisting of iron, steel, and titanium. In a preferred embodiment said steel is a plain carbon steel or micro-alloyed carbon steel having a carbon content between 0.1 wt % and 1.2 wt % by weight, any other elements being present in amounts of maximum 1.0 wt %, e.g. in amounts of maximum 0.40 wt % except for silicon and manganese which may have amounts above 0.40 wt %.

The elongated metal element may be a metal wire with a round or a non-round section, a metal filament, a metal rope, a metal cord, a metal strand, a bundle of filaments or a metal strip. By the terms "elongated element" there is meant an element having at least one cross-sectional dimension which is more than ten times smaller, e.g. more than twenty times, e.g. more than fifty times smaller than its length. The transverse cross-section of said reinforcing element may be circular, rectangular, elliptical, flat, etc.

In case that the elongated metal element is circular in cross-section, it is in the form of a filament, wire, etc. and, depending on the application it may have any diameter. For several applications a diameter ranging from 0.10 mm to 4.0 mm is appropriate.

Tensile strengths of the elongated metal element may range from 400 MPa and exceptionally up to 4000 MPa or higher. Additionally, the steel wires may be plated or not. Sometimes, in case of a steel wire the steel surface is phosphatized with a composition comprising Zn and Fe phosphates.

In a second aspect the present invention provides a method of producing the fully or partially coated elongated metal element where the method comprises the steps of (a) optionally cleaning the surface of the uncoated metal wire;

(b) optionally treating the metal wire with a primer compound;

(c) optionally solvent-free applying of (i) a functionalized polymer containing functional groups selected from carboxylic acids or anhydrides, epoxy groups, amino groups, oxazoline groups and hydroxy groups; and (ii) a compound selected from copolyamides, copolyesters, and polyamides or blends thereof; individually or sequentially or in the form of a blend to the surface of said metal substrate; or a compound selected from organo functional silanes, organo functional titanates and organo functional zirconates;

(d) applying a thermoplastic elastomer.

In a preferred embodiment step (c) and/or (d) is or are carried out by extrusion, coextrusion, dipping or powder coating.

In a specific embodiment the steps (a) to (d) are performed in the same production line.

In a specific embodiment there is provided a method for producing a non-slip clothes hanger, comprising the steps of (a) fully or partially coating an elongated metal element with a non-slip thermoplastic elastomer; and (b) mechanically deforming said coated elongated metal element into a clothes hanger. This makes of the invention a very effective and efficient way of making wire for clothes hangers since the non-slip function can be provided to the wire in a continuous and automated way and does not need to be added later on locally piece by piece.

In yet another aspect the present invention provides the use of a coated metal wire, as described above, as non-slip support for textile or paper. In a specific embodiment this non-slip support is comprised fully or partially in a clothes hanger. In another specific embodiment said non-slip support is used in a paperclip.

In one embodiment a Santoprene® coated non-slip wire may be used to make a metal frame clothes hanger which is competing in the low end market. In one embodiment a non-slip coated metal wire of the present invention is shaped into a hanger. In another embodiment only parts of the metal hanger comprise the coated metal wire of the present invention.

In one embodiment a coated metal wire is inserted partly into a wooden clothes hanger, e.g. in the shoulder part and the horizontal bar for hanging trousers.

In another embodiment a Santoprene® non-slip wire may be used to make a soft touch/high grip paper clip.

DETAILED DESCRIPTION OF THE INVENTION

Figure 1:
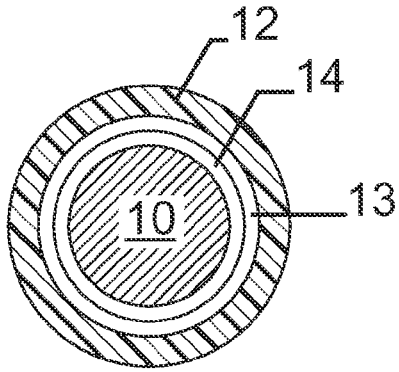
FIG. 1 shows a cross-section of a coated metal wire according to the invention.

FIG. 1 illustrates a cross-section of a coated metal wire of the present invention. The metal core 10 is applied with a coating of thermoplastic elastomer 12. An adhesion layer 13 and/or a primer layer 14 may optionally be applied between the metal core 10 and the thermoplastic elastomer coating 12.

Figure 2:
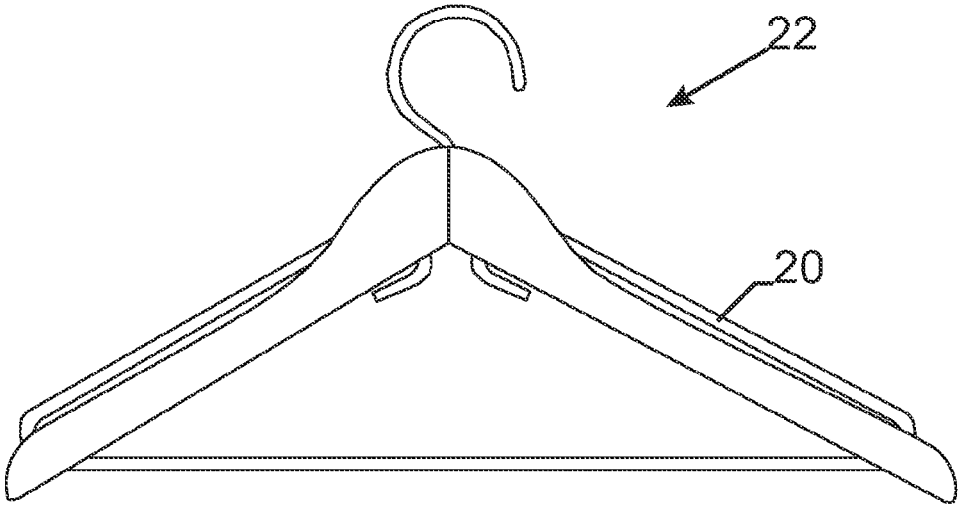
FIG. 2 shows a coated metal wire according to the invention shaped into a clothes hanger.

FIG. 2 illustrates the use of an invention wire 20 with non-slip properties in clothes hanger 22. FIG. 2 relates to one embodiment of the present invention being a triangular shaped cloth hanger 22, comprising a hook portion 24; a pair of shoulder portions 20 with top ends 27 and 29 attached to the support member 28; and a base portion 26 extending from the bottom end of the said pair of shoulder portions 20; wherein said pair of shoulder portions and said base portion is formed from a single elongated metal core provided with a thermoplastic coating selected from a group consisting of a thermoplastic elastomer and a thermoplastic polyurethane. In one embodiment of the present invention, the two ends of the shoulder portions 27 and 29 may be twisted to the neck of the hook portion 24 in absence of a support member 28. In another embodiment of the present invention, the cloth hanger excluding the hook portion is triangular shaped produced in a single operation step starting with a single elongated metal core provided with a thermoplastic coating selected from a group consisting of a thermoplastic elastomer and a thermoplastic polyurethane, from the hook portion, extending to first shoulder portion, followed by the base portion and ending in second shoulder portion wherein the top end of second shoulder portion is twisted to the neck of the hook portion. In yet another embodiment of the present invention, the cloth hanger is produced in a single operation step starting from the hook portion, extending to a shoulder portion, followed by plurality of base portions extending one below the other in a continuous zigzag manner, wherein said hook portion, shoulder portion and plurality of base portions are made from a single elongated metal core provided with a thermoplastic coating selected from a group consisting of a thermoplastic elastomer and a thermoplastic polyurethane.

The thermoplastic elastomer is a thermoplastic vulcanizate. The "plurality of base portions" refer to 2, 3, 4 or 5 base portions extending in a continuous zigzag shape.

Figure 3:
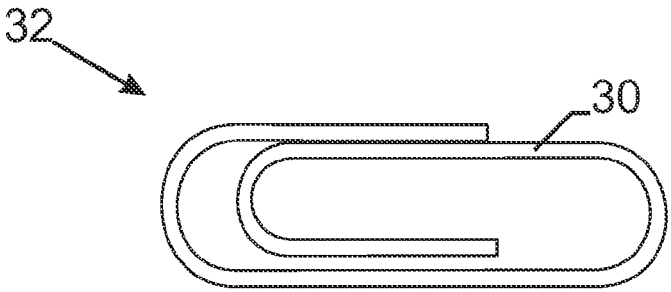
FIG. 3 shows a coated metal wire according to the invention shaped into a paper clip.

FIG. 3 illustrates the use of an invention wire 30 as a non-slip paper clip 32.

The various steps for manufacturing an invention wire are as follows: Starting product is a low-carbon wire rod with a percentage by weight of carbon of 0.2 and a diameter of 6.5 mm. The wire is dry drawn until an intermediate diameter. At this intermediate stage the wire is annealed. After annealing the wire is further dry drawn until its final diameter of e.g. 1.83 mm. The surface is then cleaned and a silane is applied to the wire by means of a dip operation. A Santoprene® 8291-85TL coating is applied to the wire by means of an extrusion operation.

Figure 4:
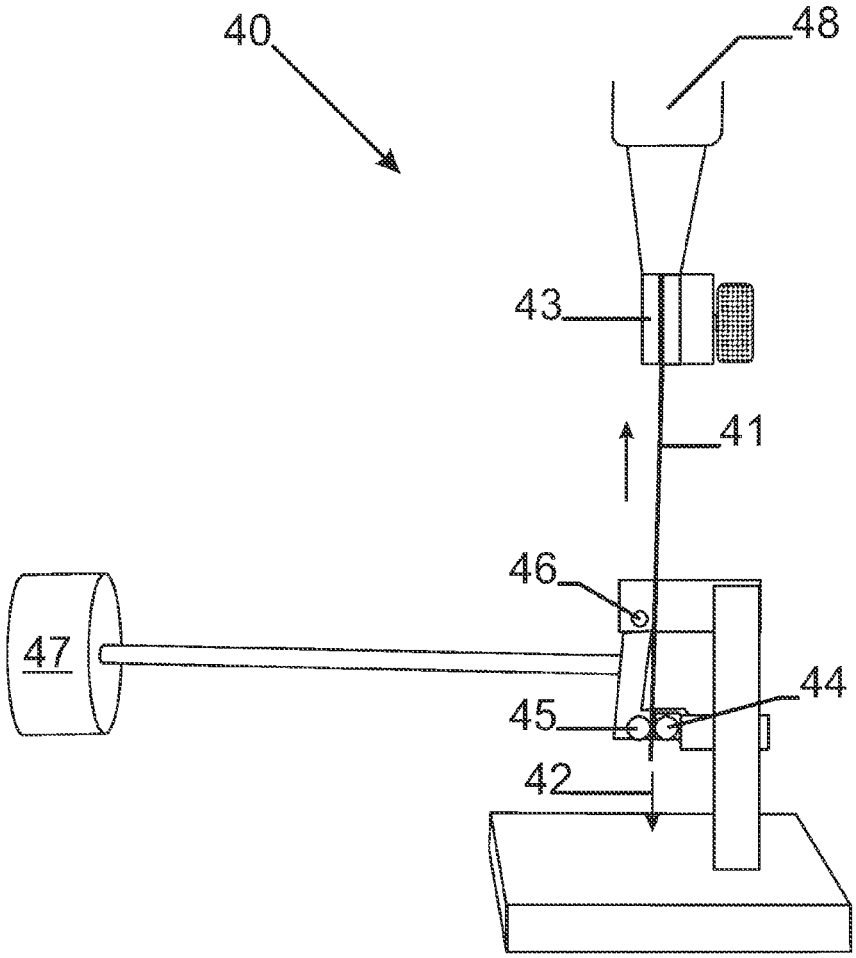
FIG. 4 shows a measuring instrument for measuring the friction coefficient of the coated metal wires according to the invention.

Method for Measuring the Anti-Slip (Friction) Behaviour of an Elongated Metal Element FIG. 4 illustrates a friction measuring instrument 40 for measuring friction coefficients of coated and uncoated metal wires 41. An axial weight 42 is positioned under the wire. The wire 41 is positioned between a clamp 43 and two roller bearings 44, 45. One roller bearing 44 is fixed, the other roller bearing 45 is rotatable around an axis movable around an axis 46. A normal force $F_n$ is exercised on the wire 41 by means of a weight 47. An upward force F is exercised on the wire 41 by means of a device which may also be used in tensile tests. This force F is recorded via a loadcell.

When measuring a circular wire, the surfaces of the two rollers is V-shaped.

Test parameters include test speed, test length, normal force and axial weight.

The static friction force $F_s$ is the force needed to get the wire move upwards and is determined by the first peak of the measured force F. Once the static force $F_s$ is determined, the static coefficient of friction $\mu_s$ can be derived.

The dynamic friction force $F_d$ is the force needed to get the wire to continue to move. The dynamic coefficient of friction $\mu_d$ is determined from the average of the dynamic friction force over the measurement path or test length.

Invention Example

Friction Properties of an Invention Wire

Figure 5:
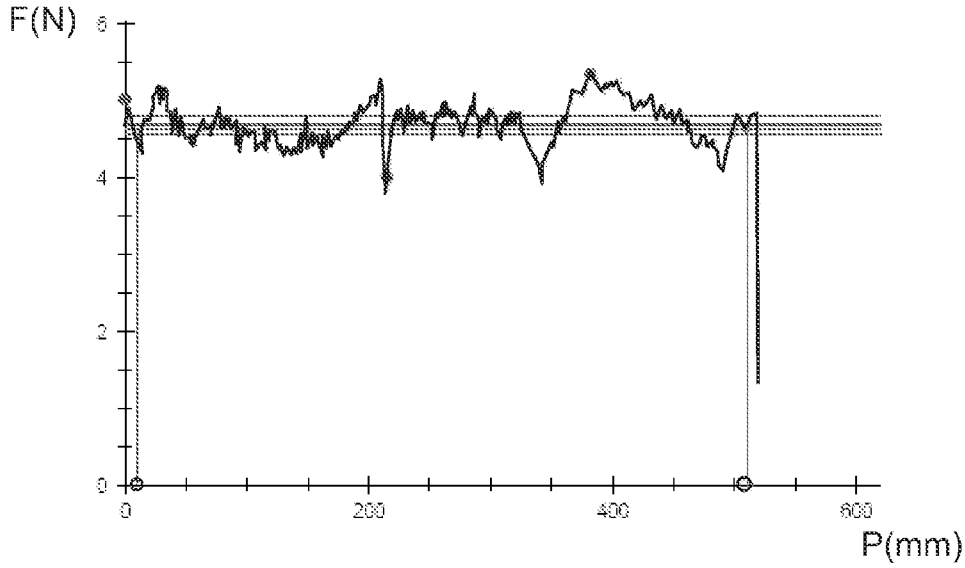
FIG. 5 shows a graph of the force needed to draw a coated metal wire according to the invention over a determined measuring path.

FIG. 5 illustrates the force F in Newton over a measurement path P in mm exercised on an invention wire.

The invention wire is a low carbon steel wire with as diameter 1.83 mm and as coating a thermoplastic vulcanizate commercialized under the trademark Santoprene® 8291-85TL.

The measurement path P is 500 mm, the normal force $F_n$ exercised on the wire is 25 Newton, the test speed is 500 mm/min.

Following friction parameters have been determined:

static friction force $F_s$=5.02 N static friction coefficient $\mu_s$=0.20060 dynamic friction force $F_d$=4.70 N dynamic friction coefficient $\mu_d$=0.18785.

Comparative Example

Friction Properties of a Prior Art Wire

Figure 6:
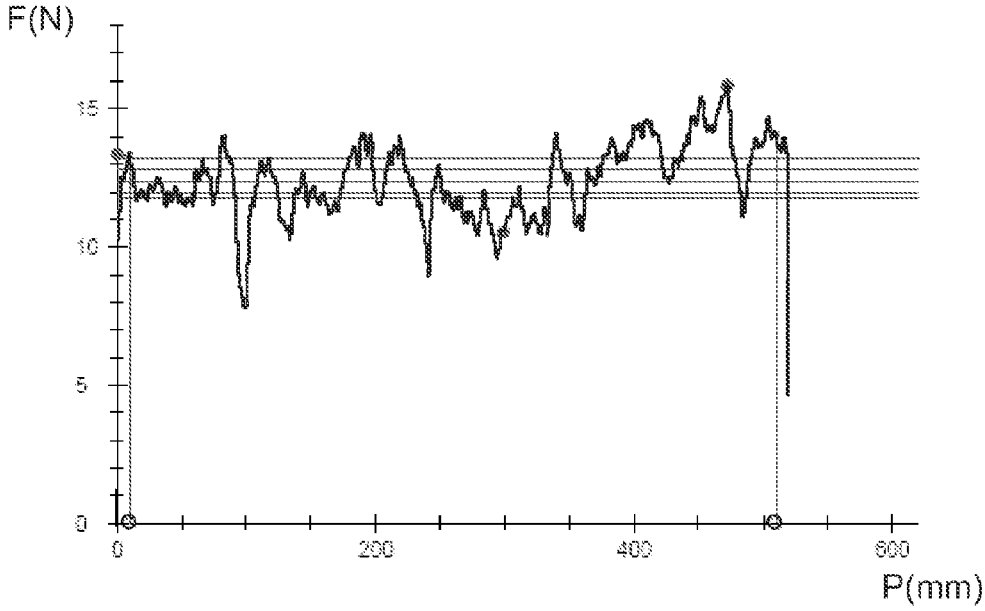
FIG. 6 shows a graph of the force needed to draw a coated PRIOR ART metal wire over a determined measuring path.

FIG. 6 illustrates the force F in Newton over a measurement path P in mm exercised on a PRIOR ART wire.

The PRIOR ART wire is a low carbon steel wire with as diameter 1.83 mm and as coating a polyester coating.

The measurement path P is 500 mm, the normal force $F_n$ exercised on the wire is 76 Newton, the test speed is 500 mm/min.

Following friction parameters have been determined:

static friction force $F_s$=13.33 N static friction coefficient $\mu_s$=0.175 dynamic friction force $F_d$=12.32 N dynamic friction coefficient $\mu_d$=0.162.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

The invention claimed is:

1. A clothes hanger, comprising:

a) a hook portion;

b) at least one shoulder portion having a top end and a bottom end;

c) at least one base portion extending from said bottom end of said shoulder portion;

d) said shoulder portion and said base portion are formed from a single elongated metal core provided with a thermoplastic coating selected from a group consisting of a thermoplastic elastomer and a thermoplastic polyurethane;

e) an adhesion layer is at least partially applied between the metal core and the thermoplastic coating, the adhesion layer including:

i) a compound selected from organo functional silanes, organo functional titanates, and organo functional zirconates.

2. The clothes hanger of claim 1, wherein said hook portion, said shoulder portion and said base portion are formed from a single elongated metal core provided with a thermoplastic coating selected from a group consisting of a thermoplastic elastomer and a thermoplastic polyurethane.

3. The clothes hanger of claim 1, wherein said thermoplastic coating is a thermoplastic elastomer and wherein said thermoplastic elastomer is a thermoplastic vulcanizate.

4. The clothes hanger of claim 1, wherein said thermoplastic coating has a static friction coefficient of at least 0.180.

5. The clothes hanger of claim 1, wherein:

a) a primer coating is interposed between the metal core and the adhesion layer.

6. The clothes hanger of claim 5, wherein said primer coating comprises a compound selected from organo functional silanes, organo functional titanates and organo functional zirconates.

7. The clothes hanger of claim 1, wherein:

a) the metal core is one of a metal and a metal alloy selected from the group consisting of iron, steel, and titanium.

8. The clothes hanger of claim 7, wherein:

a) the steel is one of a carbon steel and a micro-alloyed steel having a carbon content between 0.1 and 1.2% by weight, any other elements being present in amounts of a maximum of 1.0%, the balance being iron.

9. A method for producing a non-slip clothes hanger, comprising the steps of:

a) fully or partially coating an elongated metal element with a non-slip thermoplastic elastomer;

b) mechanically deforming said coated elongated metal element; and c) prior to said step of fully or partially coating an elongated metal element, the method includes the steps of:

i) cleaning the surface of the uncoated metal element;

ii) treating the metal element with a primer compound; and iii) solvent-free applying:

1) a functionalized polymer containing functional groups selected from carboxylic acids or anhydrides, epoxy groups, amino groups, oxazoline groups and hydroxy groups; and 2) a compound selected from copolyamides, copolyesters, and polyamides or blends thereof; individually or sequentially or in the form of a blend to the surface of said metal substrate; or a compound selected from organo functional silanes, organo functional titanates and organo functional zirconates.

10. The method of claim 9, wherein:

a) at least one of the step of solvent-free applying and the step of fully or partially coating the metal element is carried out by one of extrusion, coextrusion, dipping, and powder coating.

11. The method of claim 9, further including a step of plastically deforming the elongated metal element.

12. The method of claim 9, wherein said thermoplastic elastomer is a thermoplastic vulcanizate.

13. The method of claim 9, wherein said thermoplastic elastomer has a static friction coefficient of at least 0.180.

14. A clothes hanger, comprising:

a) a hook portion;

b) at least one shoulder portion having a top end and a bottom end;

c) at least one base portion extending from said bottom end of said shoulder portion;

d) said shoulder portion and said base portion are formed from a single elongated metal core provided with a thermoplastic coating selected from a group consisting of a thermoplastic elastomer and a thermoplastic polyurethane;

e) an adhesion layer is at least partially applied between the metal core and the thermoplastic coating, the adhesion layer including:

i) a functionalized polymer containing functional groups selected from carboxylic acids or anhydrides, epoxy groups, amino groups, oxazoline groups and hydroxy groups; and ii) a compound selected from copolyamides, copolyesters, and polyamides or blends thereof;

f) a primer coating is interposed between the metal core and the adhesion layer; and g) said primer coating comprises a compound selected from organo functional silanes, organo functional titanates and organo functional zirconates.

15. The clothes hanger of claim 14, wherein:

a) the metal core is one of a metal and a metal alloy selected from the group consisting of iron, steel, and titanium.

16. The clothes hanger of claim 15, wherein:

a) the steel is one of a carbon steel and a micro-alloyed steel having a carbon content between 0.1 and 1.2% by weight, any other elements being present in amounts of a maximum of 1.0%, the balance being iron.

17. The clothes hanger of claim 15, wherein said thermoplastic coating has a static friction coefficient of at least 0.180.

* * * * *